US005308264A

United States Patent [19]

Perretta et al.

[11] Patent Number: 5,308,264

[45] Date of Patent: May 3, 1994

[54] MODULAR BACKSHELL INTERFACE SYSTEM

[75] Inventors: Frederick A. Perretta, Huntington; Miles R. Frate, Monroe, both of Conn.

[73] Assignee: United Technologies Corporation, Hartford, Conn.

[21] Appl. No.: 47,316

[22] Filed: Apr. 15, 1993

[51] Int. Cl.[5] ..... H01R 13/658

[52] U.S. Cl. ..... 439/607; 439/901

[58] Field of Search ..... 439/607, 610, 620, 901-905

[56] References Cited

U.S. PATENT DOCUMENTS 4,382,653 5/1983 Blanchard ..... 439/610

4,889,497 12/1989 Riches ..... 439/610 X

*Primary Examiner*—Eugene F. Desmond

[57] ABSTRACT

Multi-conductor strand wiring harnesses are connected together by a backshell having several internal semi-flexible circuit boards disposed therein. A minimal non-shielded conductor window is provided between the inlet and outlet connections in the backshell. The backshell is composed of interconnected modules, one of which is connected to each wire harness, and the other of which is mounted on a grounded component of the craft. At least one of the modules contains semi-flexible circuit boards which interconnect input and output conductor pin arrays on the module. The modules are interconnected by mating pin and socket assemblies.

1 Claim, 1 Drawing Sheet

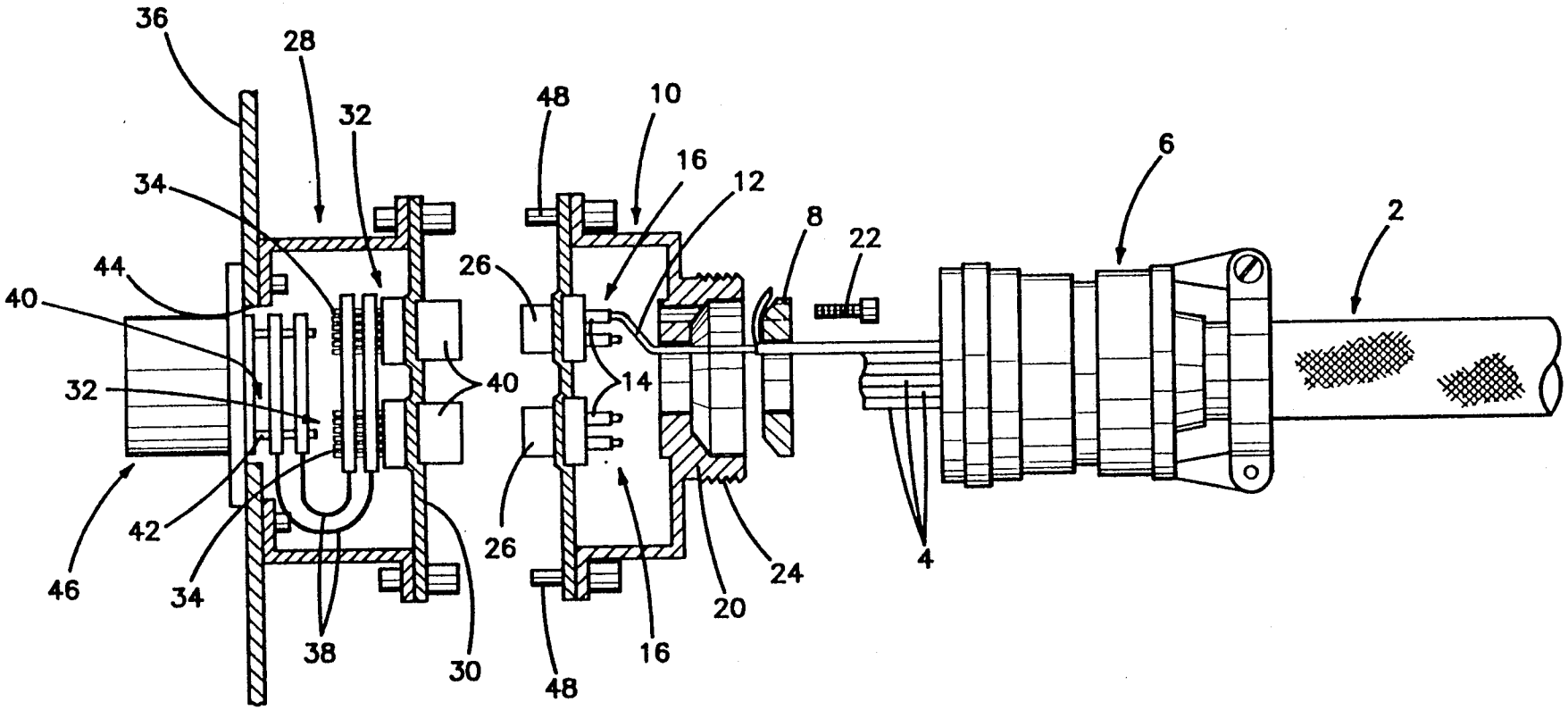
2
6
4
22
8
24
20
12
16
10
14
16
48
48
26
26
40
30
32
28
38
36
34
44
40
32
42
34
46

MODULAR BACKSHELL INTERFACE SYSTEM

TECHNICAL FIELD

This invention relates to electrical connector assemblies and more particularly to a modular compact, lightweight backshell assembly which can interconnect multiple conductor harnesses with each other.

BACKGROUND ART

Multiple conductor wire harnesses in aircraft, for example, are presently interconnected by means of insulated structures called "backshells." Present day backshells are bulky and relatively heavy structures which require one-to-one conductor connections between the inlet and outlet portions of the backshell. These backshells also do not provide efficient conductor-to-conductor EMI shielding, inside of the backshell, since the non-shielded conductors extend within the backshell from the inlet to the outlet. Excessive cross-talk or interconductor noise can thus occur within the backshells of the prior art, especially with high power transmission lines.

Since the wire harnesses have an outer bundle EMI shield which insulates the entire conductor bundle, and inner individual conductor EMI shields, both of which must be stripped and grounded before the conductor wires enter the backshell, the unshielded wires will necessarily be vulnerable to EMI noise inside of the backshell although they will be shielded by the backshell from ambient surroundings. Conductors which must be protected from noise of any kind thus cannot be interconnected by the prior art back-shells, as they exist at the present time. The prior art backshells are also lengthy, and increase in length the more conductors are fed into them.

DISCLOSURE OF THE INVENTION

This invention relates to an improved conductor bundle harness backshell connector assembly which provides for improved conductor EMI shield grounding so that a minimal unshielded conductor window exists in the assembly. The connector assembly includes a multiple component backshell housing, which is electrically grounded to the aircraft, or the like. The outer bundle shield is preferably grounded to the backshell by means of a first conductive ferrule assembly which telescopes under the stripped outer insulation shield and over the inner shielded conductor wires. The inner individual conductor shields are grounded to one component of the backshell by means of a ground ring which telescopes under the inner conductor shields and under the ferrule assembly. The telescoping ferrule assembly and ground ring enable the shielding to be grounded to the backshell in a minimal spatial envelope. The aforesaid grounding assemblies are disclosed in greater detail in copending U.S. Ser. No. 07/998,221, filed Dec. 30, 1992.

The backshell assembly of this invention is modular in construction. It includes multiple mating modules, one of which is connected to a conductor wire harness, and another of which is mounted on a grounded component of the aircraft, such as an equipment rack. The grounded housing module includes one or more junctions for electrical operating equipment on the craft, such as microprocessors, instrumentation and other electrical equipment. Once inside of the wire harness module of the backshell, the conductor wires are stripped and connected directly to a multi-pin connector array which is contained in the harness module of the backshell. The grounded module of the backshell is provided with one or more semi-flexible circuit boards which are connected on opposite ends to pin connector arrays. One of the pin connector arrays faces the wire harness backshell housing module, and the other pin connector array projects through an opening in the equipment rack and provides a pin and socket junction to which electrical instrumentation on the craft can be connected. The circuit board or boards define the signal transmission paths between the two conductor pin arrays, and will include, internally within the board structure, whatever signal path splices which may be necessary. The circuit boards are operable to shield the individual wires from EMI noise which emanates from the other conductor wires in the bundle. The unshielded portion of conductor wires between the conductor pin arrays is therefore minimized; and the degree of interconductor wire EMI noise is also minimized. The use of the semi-flexible circuit boards inside of the backshell enables the size and weight of the backshell to be significantly reduced, and greatly increases the versatility of the interface system. The boards in the backshell also allow FM, HF, VHF and LF signal conductors to be connected by the interface system of this invention.

The wire harness housing module receives the stripped individual conductor wires from the wiring harness, and includes the grounding assembly described generally above. The individual conductor wires are fed through the grounding assembly and into the backshell housing where they are connected to individual pins in a pin array mounted on a wall of the backshell housing which faces the grounded backshell housing module. The pins on the aforesaid wiring harness backshell pin array extend through the wall of the harness backshell module and are positioned so as to match the pin array on the grounded backshell module wall. The wiring harness backshell module is plugged into the grounded backshell module, and fastened thereto, so as to ground both of the backshell modules in the assembly.

It is therefore an object of this invention to provide an improved backshell interface system for interconnecting conductor wire harnesses in aircraft or the like.

It is an additional object of this invention to provide an interface system of the character described which minimizes interconductor wire EMI interference.

It is a further object of this invention to provide an interface system of the character described which is of modular construction.

These and other objects and advantages of the invention will become more readily apparent from the following detailed description of the preferred embodiment of the invention when taken in conjunction with the accompanying drawing which is an exploded view partly in section of a preferred embodiment of a modular backshell interface system formed in accordance with this invention.

DESCRIPTION OF THE DRAWING

The drawing shows an exploded view of the interface system.

DETAILED EMBODIMENT OF THE INVENTION

Referring now to the drawing, there is shown a specific embodiment of the invention. The conductor wire bundle 2 is shielded from ambient EMI by an outer bundle shield; and the individual conductor wires 4 in the bundle are each insulated from EMI emanating from others of the conductor wires. The conductor bundle 2 passes through an outer shield grounding assembly 6, and the individual wires 4 are then stripped and fed through a grounding ferrule 8 into a wire harness backshell module 10 wherein the stripped conductor wires 12 are individually soldered to connector pins 14 in first connector pin arrays 16. The first connector pin arrays 16 are mounted on a wall 18 of the wire harness backshell module 10. The ferrule 8 is telescoped into a boss 20 on the harness backshell module 10, and is secured to the module 10 by a set screw 22. The boss 20 is provided with external threads 24 onto which the shielding assembly 6 is threaded. The first pin arrays 16 include socket plug portions 26 which project beyond the backshell module wall 18.

The connector assembly also includes a backshell module 28 which is mounted onto, and grounded by a component 36, such as an equipment rack, that is grounded to the aircraft air frame. The grounded backshell module 28 includes a wall 30 which faces the wall 18 of the harness backshell module 10. A plurality of pin connector arrays 32 are mounted on the module wall 30. The pin arrays 32 each include a plurality of conductor pins 34 which are disposed inside of the module 28. The pins 34 are connected to one end of one or more semi-flexible circuit boards 38 which are disposed inside of the grounded backshell module 28. The conductor pins 34 form a part of an interface assembly which is mounted on the wall 30, and which includes one or more socket portions 40 which project from the backshell wall 30 toward the pin array plugs 26 or the harness backshell module 10. The pin array plugs 26 and the pin array sockets 40 are configured in mating fashion so as to form mating connections between the conductor wires 12 and the circuit boards 38.

The circuit boards 38 are connected at their other ends to a conductor pin array 40 comprising individual pins 42 which extend through an opening 44 in the aircraft equipment rack 36 to a pin plug array 46 which provides connections to operational instruments and other electrical equipment in the aircraft. Any splices which may be necessary between the pin array 32 and the pin array 40 are formed in the circuit boards 38.

The system is assembled by interfacing the plugs 26 with the sockets 40. The backshell modules 10 and 28 are then fastened together by a plurality of screws 48 so as to ground the harness backshell module 10 to the rack 36.

It Will be readily appreciated that the interface assembly of this invention is very compact and lightweight and is system-oriented in that it can be used with a wide range of different operating systems. When used in an aircraft, such as a helicopter, the backshell is grounded to the aircraft frame, and the conductor harness shields are grounded to the backshell. The window of unshielded conductor wires is minimal due to the use of the telescoping grounding elements. The spacing apart of the conductor-contacting ends of the circuit boards inside of the backshell provides enhanced protection against overheating in the backshell despite the small size of the backshell. As previously noted, if a system in the aircraft is changed, one or both of the modules can be opened and different circuit boards can be inserted into the backshell. A new or modified harness can be fitted onto the harness module and connected to the harness module pin arrays. The initial interface assemblies and all modifications thereof can be bench tested, and once the prototype is debugged, all of the successive units are assured of proper operation due to the use of the circuit boards rather than individual conductor wires inside of the backshell. Backshells which employ this invention may accommodate larger numbers of conductors in a smaller, lighter package. Space and weight are thus conserved, and the communications are sped up because of the reduced lengths of conductor inside of the backshell, as compared to the prior art.

Since many changes and variations of the disclosed embodiment of the invention may be made without departing from the inventive concept, it is not intended to limit the invention otherwise than as required by the appended claims.

What is claimed is:

1. An interface system for interconnecting multiconductor bundle harnesses in a grounded environment, said system comprising:

a) an ambient-EMI shielding grounded backshell module which is grounded to said grounded environment and which includes signal connector means for interconnection with electrically operated equipment;

b) an incoming multi-conductor bundle harness having an outer EMI shielding, a plurality of conductor wires shielded from ambient EMI by said outer shielding; and said conductor wires being shielded from interconductor EMI by inner individual EMI shields;

c) a harness backshell module which receives stripped conductor wires from said harness;

d) said grounded module and said harness module including interfitting pin and socket connectors for establishing signal paths between conductors in said harness with said grounded backshell signal connector means; and e) a plurality of semi-flexible circuit boards disposed in said grounded backshell module, said circuit boards containing internal shielded circuit lines which are electrically connected at one end of a pin array in said grounded module and which are connected at an opposite end to said signal connector means.

* * * * *